US005512191A

United States Patent [19]

Krueger

[11] Patent Number: 5,512,191

[45] Date of Patent: Apr. 30, 1996

[54] AQUEOUS FUNCTIONAL FLUID HAVING IMPROVED RESISTANCE TO MICRO-ORGANISMS

[75] Inventor: Mark K. Krueger, Loveland, Ohio

[73] Assignee: Cincinnati Milacron Inc., Cincinnati, Ohio

[21] Appl. No.: 412,353

[22] Filed: Mar. 28, 1995

Related U.S. Application Data

[63] Continuation of Ser. No. 171,496, Dec. 22, 1993, abandoned.

[51] Int. Cl.[6] ..... C10M 173/02

[52] U.S. Cl. ..... 252/49.3; 252/51.5 A; 252/51.5 R; 72/42

[58] Field of Search ..... 252/49.3, 51.5 A, 252/51.5 R, 77, 78.1; 72/42

[56] References Cited

U.S. PATENT DOCUMENTS

| | | | |
|---|---|---|---|
| 3,923,870 | 12/1975 | Singer | 260/482 |
| 4,746,450 | 5/1988 | Frentrup et al. | 252/75 |
| 4,749,503 | 6/1988 | Bennett et al. | 252/49.3 |
| 4,846,983 | 7/1989 | Ward, Jr. | 252/33.6 |
| 4,925,582 | 5/1990 | Bennett | 252/49.3 |
| 4,944,892 | 7/1990 | Leathers | 252/92 |
| 4,945,109 | 7/1990 | Rayudu | 514/478 |
| 4,964,892 | 10/1990 | Hsu | 71/67 |
| 4,990,525 | 2/1991 | Hsu | 71/67 |
| 5,041,457 | 8/1991 | Hsu | 71/67 |
| 5,106,519 | 4/1992 | Mauthner et al. | 252/49.3 |
| 5,147,890 | 9/1992 | Whitekettle et al. | 514/479 |
| 5,147,891 | 9/1992 | Donofrio et al. | 514/479 |
| 5,156,665 | 10/1992 | Sherba et al. | 71/67 |
| 5,179,127 | 1/1993 | Hsu | 514/844 |

FOREIGN PATENT DOCUMENTS 0006723 4/1993 WIPO .

OTHER PUBLICATIONS

Patent Abstracts of Japan, Abstract No. 62–81493; Japanese Appln. No. 60–220845; Mold Lubricant for Hot Forging Jul. 15, 1988.

Patent Abstracts of Japan, Abstract No. 02–164803, Japanese Appln. No. 63–317431; Stable Microbicidal Composition Jul. 26, 1990.

Patent Abstracts of Japan, Abstract No. 63–44504; Japanese Appln. No. 61–187992; Antimicrobial Agent No date available.

Patent Abstracts of Japan, Abstract No. 63–41405; Japanese Appln. No. 61–186222; Microbicide Sept. 11, 1987.

Patent Abstracts of Japan, Abstract No. 02–120001; Japanese Appln. No. 63–274211; Manufacture of Antisepsis–Treated Plywood Sep. 13, 1990.

Technical Data Sheet Troysan Polyphase P–100, Troy Chemical Corporation; Jun. 1985.

*Primary Examiner*—Margaret Medley

*Attorney, Agent, or Firm*—John W. Gregg; Donald Dunn

[57] ABSTRACT

An aqueous functional fluid composition free of formaldehyde and formaldehyde producing agents, more especially an aqueous metalworking fluid composition, having improved resistance to attack by microorganisms is provided. This fluid comprises a) water, b) a water soluble or dispersible functioning agent (e.g. water soluble or dispersible organic lubricant) and c) an antimicrobial effective amount of the combination of d) a water soluble or dispersible nitrogen bearing organic compound (e.g. monoethanolamine) and e) a water soluble or dispersible haloalkynylalkyl carbamate (e.g. 1-iodo-3-propynylbutyl carbamate).

9 Claims, No Drawings

AQUEOUS FUNCTIONAL FLUID HAVING IMPROVED RESISTANCE TO MICRO-ORGANISMS

This is a continuation of application Ser. No. 08/171,496 filed on Dec. 22, 1993, now abandoned.

FIELD OF INVENTION

This invention relates to aqueous based functional fluid compositions particularly adapted for uses such as metalworking fluid composition and to the improvement in the resistance of such fluids to attack by micro-organisms.

BACKGROUND

Multicomponent aqueous based liquid compositions having commercial and industrial applications, containing materials that cause or support the formation and growth of microorganisms which result in the breakdown and/or reduction of the functional effectiveness of the composition are well known. Such water based multicomponent compositions include, for example, aqueous based metalworking fluids, hydraulic fluids, cooling fluids, damping fluids and heat transfer fluids. Aqueous based metalworking fluids and hydraulic fluids have been gaining in importance over non-aqueous metalworking and hydraulic fluid compositions because of their economic, environmental and safety advantages. Water based metalworking fluid compositions have been used in chip forming and non-chip forming metalworking processes well known in the art such as drilling, tapping, broaching, grinding, rolling, drawing, spinning, milling, bending and stamping. The demand for aqueous based hydraulic fluid compositions such as may be used in hydraulic cylinders and pumps, has been increasing because of the economic and safety (e.g. high non-flammability) advantages of such fluids over non-aqueous, oil type hydraulic fluids. The increasing cost and disposal problems of non-aqueous, oil based functional fluid compositions has accelerated the demand for aqueous based functional fluid compositions.

The multicomponent water based functional fluid composition is however known to contain organic constituents that are subject to attack by microorganisms (e.g. bacteria, mold, fungus etc.) which leads to a breakdown (i.e. instability) of those constituents and the composition resulting in a loss in its functional effectiveness (e.g. rancidity, loss of friction reduction and corrosion control). This attack by microorganisms has been the focus of much concern and activity in the art pertaining to aqueous functional fluid compositions. Such concern and activity has lead to numerous prior art compounds and compositions for preventing or retarding the microorganism attack on aqueous functional fluid compositions.

Formaldehyde and formaldehyde producing compounds have been employed in the art for some time now to combat the attack on many organic constituents in commercial and industrial aqueous systems by a variety of microorganisms. Although formaldehyde and formaldehyde producing compounds have been found to be effective in a number of instances, their usage in aqueous systems is decreasing. Considerable work has been done in the art to combat the microbial attack on commercial and industrial aqueous based fluids using compounds other than formaldehyde and formaldehyde producing compounds.

Iodopropargyl compounds have been disclosed as microbiocides for a variety of systems including paints, wood, adhesives, glue, paper, textiles, plastics, cardboard, lubricants, cooling water, cutting fluids and metalworking fluids (U.S. Pat. No. 5,179,127 to A. C. Hsu). S. E. Sherba et.al. (U.S. Pat. No. 5,156,665) have taught a synergistic combination of 2-alkyl-3-isothiazolones and certain iodopropargyl compounds (e.g. N-iodopropargyloxycarbonyl glycine methyl ester) for use in fabric, leather, wood, paper, fuel and metalworking fluid (unspecified). The combination of 3-iodo-2-propynyl butyl carbamate and phenyl-(2-cyano-2-chlorovinyl) sulfone in water containing system has been reported by D. K. Donofrio et.al. in U.S. Pat. No. 5,147,891. A combination of a carbamate and a sulfamide as a bactericidal composition for water containing systems has been employed by W. K. Whitekettle et.al. (U.S. Pat. No. 5,147,890). The inhibition of microbial growth in oil in water emulsion metalworking fluids by a combination of the reaction product of a salt of copper and an alkanolamine and the product of the reaction between a salt of molybdenum and an alkanolamine has been disclosed by T. Mauthner et.al. (U.S. Pat. No. 5,106,519). A 3oiodopropargyl ester of carbamic acid has been used to combat micro-organism growth in aqueous based paint and metalworking fluid (U.S. Pat. No. 4,945,109 S. R. Rayudu). N-hexyl-ethanol amine has been reported to inhibit microbial growth in industrial water based coolants and in cutting fluids or metalworking fluids (U.S. Pat. No. 4,925,582 - E. O. Bennett and U.S. Pat. No. 4,749,503 E. O. Bennett et.al.). The addition of molybdenum or tungsten thiocarbamate to lubricating oils or automatic transmission fluids has been reported by W. C. Ward (U.S. Pat. No. 4,846,983). Latex paint formulations containing a 1-halogen substituted lower molecular weight alkyne (e.g. butyl urethane of 4-hydroxy-1-iodopropyne) has been described by W. Singer in U.S. Pat. No. 3,923,870.

Orthopenylphenol, a material difficult to solubilize in water, has in some systems afforded good fungal control, but has offered inefficient bacterial control. Copper and copper compounds have been employed in the art to control odors developed by micro-organisms in some aqueous systems but has provided poor control over bacteria growth. Admixtures of methylchoroisothiazoline and methyl isothiazolone have been employed in the art to control micro-organism growth in aqueous systems but has exhibited instability in alkaline systems (e.g. alkaline aqueous metalworking fluids). Alkyl parabens (e.g. methyl, ethyl and propyl) have exhibited good antimicrobial activity but are known to be expensive, and have poor water solubility.

Generally biocides are sought that have a broad spectrum of activity against micro-organism growth and wide applicability in respect to the types and compositions of the systems they are intended to protect against attack by plant and animal micro-organisms. Some of the bacteria against which the biocides are directed include Salmonella choleraesuis, Serratia marcescens, Klebsiella pneumoniae, Enterobacter aerogenes, Aerobacter aerogenes, Pseudomonas subtilis, Proteus vulgaris, Streptococcus faecalis, Pseudomonas aeruginosa, Escherichia coli and Staphlococcus aureus. Fungi and yeasts against which these agents may be directed can include Aspergillus niger, Candida ablicans, Lentinus lepideus, Gluoeophyllum trabeum, Coroiulus yersicolor, Trichoderms viride, Alternario alternata, Penicillium decembens, Botrytis cinerea, Collectotricyma coffeanum, Verticillium dahliae and Trichophyton mentagrophytes.

In aqueous based functional fluids, such as for example aqueous based metalworking fluid and aqueous based hydraulic fluid compositions, prior art biocides (i.e. agents to prevent or retard the growth of micro-organisms and the attack of micro-organisms on components of aqueous based functional fluid compositions) have been found to be lacking in a combination of effectiveness, stability, ease of use and economy. Thus there has been a need to overcome these problems in formulating operationally effective, long life and cost effective aqueous based functional fluids.

It is an object of this invention to provide an aqueous based functional fluid composition having a compatible, stable, effective agent to combat the growth of micro-organisms therein and the attack of microorganisms on components thereof.

It is another object of this invention to provide an aqueous based functional fluid composition having high resistance to the growth of and attack by micro-organisms.

A further object of this invention is to provide an aqueous functional fluid composition having resistance to the growth of and attack by micro-organisms while being free of formaldehyde and formaldehyde producing biocide agents.

A still further object of this invention is to provide an aqueous based metalworking fluid composition that is highly resistant to the growth of and attack by micro-organisms.

These and other objects, as will be apparent to those skilled in the art, are achieved in accordance with the invention disclosed and claimed herein.

SUMMARY OF INVENTION

There is provided in accordance with this invention an aqueous based functional fluid composition of improved resistance to the growth of and attack by micro-organisms comprising water, a water soluble or dispersible functioning agent and an antimicrobial effective amount of a combination comprising a water soluble or dispersible nitrogen bearing organic compound or salt thereof selected from the group consisting of substituted and unsubstituted aliphatic, aromatic and alicyclic primary amines and salts thereof and 5 and 6 membered ring heterocyclic compounds having at least one nitrogen ring atom and optionally oxygen or sulfur hetero ring atoms and salts thereof and a water soluble dispersible haloalkynylalkyl carbamate.

DESCRIPTION OF THE INVENTION

In accordance with this invention aqueous based functional fluids (e.g. a water based metalworking fluid, water based hydraulic fluid, water based glass grinding fluid, water based stone grinding or polishing fluid and water based fluid for machining plastics) are provided that have improved resistance to the growth of and attack by micro-organisms (e.g. plant and animal). The aqueous functional fluid compositions of this invention exhibit improved retention of antimicrobial behavior (e.g. the stability and duration of the antimicrobial behavior is improved) thereby imparting improved useful life and cost effectiveness to the fluid.

There is provided in accordance with this invention an aqueous based functional fluid composition free of formaldehyde and formaldehyde producing agents comprising a) water, b) a water soluble or dispersable functioning agent and c) an antimicrobial effective amount of the combination comprising d) a water soluble or dispersible nitrogen bearing organic compound or salt thereof selected from the group consisting of substituted and unsubstituted aliphatic, aromatic and alicyclic primary amines and salts thereof and 5 and 6 membered ring heterocyclic compounds having at least one nitrogen ring atom and optionally oxygen or sulfur hetero ring atoms and salts thereof and e) a water soluble or dispersible carbamate having the following formula $$\left[ X-C\equiv C-(CH_2)_n-O-\overset{\overset{O}{\|}}{C}-\overset{\overset{H}{|}}{N} \right]_m -R$$

where

X is fluorine, chlorine, bromine or iodine,

R is an aliphatic, aromatic or alkylaromatic group having from one to twenty carbon atoms and having a free valence equal to m, m is a whole integer of from 1 to 3 and n is a whole integer of from 1 to 3.

In a preferred practice of this invention there is provided an aqueous based metalworking fluid composition free of formaldehyde and formaldehyde producing agents comprising a) water, b) a water soluble or dispersible functioning agent and c) an antimicrobial effective amount of the combination comprising d) a water soluble or dispersible nitrogen bearing organic compound or salt thereof selected from the group consisting of substituted and unsubstituted aliphatic, aromatic and alicyclic primary amines and salts thereof and 5 and 6 membered ring heterocyclic compounds having at least one nitrogen ring atom and optionally oxygen or sulfur hetero ring atoms and salts thereof and e) a water soluble or dispersible carbamate having the following formula $$\left[ X-C\equiv C-(CH_2)_n-O-\overset{\overset{O}{\|}}{C}-\overset{\overset{H}{|}}{N} \right]_m -R$$

where

X is bromine, chlorine, fluorine or iodine,

R is an aliphatic, aromatic or alkylaromatic group having from 1 to 20 carbon atoms and a valence equal to m, m is a whole integer from 1 to 3 and n is a whole integer from 1 to 3.

The aqueous based metalworking liquid composition according to this invention may be an oil in water emulsion type, a semi-synthetic type or a synthetic type fluid. All of these types of metalworking fluids and their general nature are well known in the art. An aqueous based hydraulic fluid composition may be provided in accordance with this invention that comprises a) water, b) a water soluble or dispersible hydraulic agent and c) an antimicrobial effective amount of the combination comprising d) a water soluble or dispersible nitrogen bearing organic compound or salt thereof selected from the group consisting of substituted and unsubstituted aliphatic, aromatic and alicyclic primary amines and salts thereof and 5 and 6 membered ring heterocyclic compounds having at least one nitrogen ring atom and optionally oxygen or sulfur hetero ring atoms and salts thereof and e) a water soluble or dispersible carbamate having the following formula $$\left[ X-C\equiv C-(CH_2)_n-O-\overset{\overset{O}{\|}}{C}-\overset{\overset{H}{|}}{N} \right]_m -R$$

where

X is bromine, chlorine, fluorine or iodine,

R is an aliphatic, aromatic or alkylaromatic group having from 1 to 20 carbon atoms and a valence equal to m, m is a whole integer from 1 to 3 and n is a whole integer from 1 to 3.

The aqueous based hydraulic fluid compositions generally contain materials (e.g. hydraulic agents) that transmit or assist in the transmission of force or pressure and may at the same time serve as a lubricant. Alternatively the hydraulic agent and a lubricant may be separate and distinct materials. The term hydraulic agent as used in this specification and claims means a material that transmits or assists in the transmission of force or pressure.

An aqueous based functional fluid composition free of formaldehyde and formaldehyde producing agents, more particularly an aqueous based metalworking fluid composition, in accordance with one embodiment of this invention comprises a) water, b) a water soluble or dispersible organic lubricant and c) an antimicrobial effective amount of the combination of d) a water soluble or dispersible nitrogen bearing organic compound or salt thereof selected from the group consisting of substituted and unstubstituted aliphatic, aromatic and alicyclic primary amines and salts thereof and 5 and 6 membered ring heterocyclic compounds having at least one nitrogen ring atom and optionally oxygen or sulfur hetero ring atoms and salts thereof and e) a water soluble or dispersible carbamate having the formula $$\left[ I-C\equiv C-(CH_2)_n-O-\overset{\overset{O}{\|}}{C}-\overset{\overset{H}{|}}{N} \right]_m -R$$

where

R is an aliphatic, aromatic or alkylaromatic group having from 1 to 20 carbon atoms and a free valence equal to m, m is a whole integer from 1 to 3 and n is a whole integer from 1 to 3.

There may be employed in the further practice of this invention an aqueous based functional fluid composition free of formaldehyde and formaldehyde producing agents, more particularly an aqueous based metalworking fluid composition, having a water soluble or dispersible oil as the organic lubricant component. Where the oil used is a water dispersible oil (e.g. sulfonated petroleum based oil) an oil in water emulsion type aqueous metalworking fluid composition would be formed in accordance with this invention. Such an oil in water emulsion may be formed with or without the inclusion of surfactant or other emulsifying agents in the composition. A water soluble or dispersible synthetic organic compound (e.g. esters and polyesters) as the organic lubricant component of this composition may be used to produce a synthetic type aqueous based metalworking fluid composition in accordance with this invention. A still further practice of the aqueous based functional fluid composition, more particularly an aqueous based metalworking fluid composition, according to this invention would employ a water soluble or dispersible hydroxyl substituted aliphatic primary amine or salt thereof as the nitrogen bearing organic compound component of the combination of d) and e) of the composition. Another practice of the aqueous based functional fluid composition, more particularly the aqueous metalworking fluid composition, in accordance with this invention would employ a water soluble or dispersible aromatic primary amine or salt thereof as the nitrogen bearing organic compound component of the combination comprising d) and e) of the composition. In a further practice of the aqueous based functional fluid composition more particularly the aqueous based metalworking fluid in accordance with this invention there may be employed a water soluble or dispersible alicyclic organic primary amine or salt thereof as the nitrogen bearing organic compound constituent of the combination comprising d) and e) of the composition. A heterocyclic organic nitrogen bearing organic compound or salt thereof may be used as the nitrogen bearing organic compound component of the combination of d) and e) of the aqueous based functional fluid composition in accordance with a still further practice of this invention.

The combination consisting of the water soluble or dispersible nitrogen bearing organic compound or salt thereof selected from the group consisting of substituted and unsubstituted aliphatic, aromatic and alicyclic primary amines and salts thereof and 5 and 6 membered ring heterocyclic compounds having at least one nitrogen ring atom and optionally oxygen or sulfur hetero ring atoms and salts thereof and a water soluble or dispersible carbamate having the following formula $$\left[ X-C\equiv C-(CH_2)_n-O-\overset{\overset{O}{\|}}{C}-\overset{\overset{H}{|}}{N} \right]_m -R$$

where

X is bromine, chlorine, fluorine or iodine,

R is an aliphatic, aromatic or alkylaromatic group having from 1 to 20 carbon atoms and a free valence equal to m, m is a whole integer from 1 to 3 and n is a whole integer from 1 to 3 employed in the aqueous functional fluid composition, particularly the aqueous based metalworking fluid composition, and aqueous based hydraulic fluid composition, according to this invention may be selected in accordance with the composition and intended use of the fluid and in accordance with the environmental conditions (e.g. micro-organisms) to be encountered by the fluid. Thus numerous combinations of the nitrogen bearing organic compound and carbamate are possible and usable in the practice of this invention. There may be employed in the practice of this invention the combination of a water soluble or dispersible aliphatic primary amine or salt thereof and the carbamate according to the formula given herein wherein X is iodine, R is an alkyl group having 1 to 20 carbon atoms, m is 1 and n is 1. In another practice of the aqueous fluid composition of this invention there may be used the combination of a water soluble or dispersible aromatic primary amine and the carbamate according to the formula given herein wherein X is iodine, R is an alkyl group having from 1 to 20 carbon atoms, m is 1 and n is 1. A further practice of the aqueous fluid according to this invention may utilize the combination of a water soluble or dispersible alicyclic primary amine or salt thereof and the carbamate according to the formula given herein wherein X is iodine, R is an alkyl group having 1 to 20 carbon atoms, m is 1 and n is 1. There may be employed a combination of a water soluble or dispersible 5 and 6 membered ring heterocyclic compound having at least one nitrogen ring atom and optionally oxygen or sulfur hetero ring atoms and salts thereof and a carbamate according to the formula given herein wherein X is iodine, R is an alkyl group having from 1 to 20 carbon atoms, m is 1 and n is 1 in a still further practice of the aqueous functional fluid composition of this invention. In a more particular practice of the aqueous functional fluid composition of this invention there may be employed the combination of a water soluble or dispersible hydroxyl substituted aliphatic primary amine and a carbamate according to the formula given herein wherein X is iodine, R is an alkyl group having from 1 to 20 carbon atoms, m is 1 and n is 1.

Various water soluble or dispersible nitrogen bearing organic compounds or salts thereof selected from the group consisting of substituted and unsubstituted aliphatic, aromatic and alicyclic primary amines and salts thereof and 5 and 6 membered ring heterocyclic compounds having at least one nitrogen ring atom and optionally oxygen or sulfur hetero ring atoms and salts thereof may be employed in the combination of the aqueous functional fluid composition of this invention and can include monoamines and polyamines. The amine may be unsubstituted or may have such substituents as halogen or hydroxyl groups. The aliphatic primary amine may be branched or a straight chain amine. The alicyclic primary amine may be a cycloaliphatic mono or polyamine. Examples of aliphatic primary amines include, but are not limited to, aliphatic monoamines having 2 to 8 carbon atoms (e.g. ethyl amine, propyl amine, isopropyl amine, butyl amine, isobutyl amine, pentyl amine, hexyl amine, 2-ethyl butyl amine, octyl amine, 2-ethyl hexyl amine) and hydroxy substituted aliphatic primary monoamines (e.g. monoethanolamine, mono-propanolamine, monoisopropanolamine, monobutanolamine, mono-hexanolamine, monooctanolamine and 2-ethyl hexanolamine). Examples of aliphatic polyamines include, but are not limited to, ethylene diamine, propylene diamine, butylene diamine, octylene diamine, 1,6 amino-2-ethyl hexylene,1,6 -hexamethylene diamine, N,N-dimethyl amino propyl amine, hydroxyethyl ethylene diamine, N-propyl-N' -hydroxybutyl-1,6-hexamethylene diamine and diethylene triamine. The aliphatic primary amines usable in the combination of the aqueous functional fluid composition of this invention can include heteroaliphatic mono and polyamines having oxygen or nitrogen heteroatoms, examples of which include, but are not limited to, water soluble or dispersible polyoxyalkylene monoamine homopolymers, random copolymers and block copolymers (e.g. polyoxyethylene monoamine, poly(oxyethylene-oxypropylene) monoamine), polyoxalkylene diamine homopolymers, random copolymers and block copolymers (e.g. polyoxyethylene diamine, polyoxy-propylene diamine and poly(oxyethyleneoxypropylene)diamine). Generally the homopolymeric and copolymeric heteroaliphatic mono and polyamines will be of lower molecular weight (e.g. from about 100 to 2000). A halogen (e.g. chlorine or bromine) substituted alkyl primary amine (e.g. 2-chloroyl- amino ethylene, 3 -bromo-1-amino butylene and 6-chloro-1-amino hexamethylene) may be used as an aliphatic primary amine in the combination of the aqueous functional fluid composition of this invention.

The nitrogen bearing organic compound component of the combination of the aqueous functional fluid composition according to this invention may be a water soluble or dispersible aromatic primary amine or salt thereof examples of which include 'but are not limited to' aniline, m-toluidine, p-toluidine, p-aminophenol and m-aminophenol. Examples of water soluble or dispersible alicyclic primary amines which may be employed in the combination of the aqueous functional fluid composition of this invention include cyclohexylamine. Water soluble or dispersible 5 and 6 membered ring heterocyclic compounds having at least one nitrogen ring atom and optionally oxygen or sulfur hetero ring atoms and salts thereof usable in the combination of the aqueous functional fluid composition of this invention include, for example, morpholine, piperazine, triazole and tetrahydro-1, 4-oxazine.

In the practice of this invention there may be employed a salt of the nitrogen bearing organic compound in the combination of the aqueous functional fluid composition. Such a salt may render a water insoluble nitrogen bearing organic compound sufficiently water soluble or dispersible to make the compound useful in the practice of this invention. Thus in accordance with this invention it is the nitrogen bearing organic compound or the salt thereof that is to be water soluble or dispersible.

There is employed in the nitrogen bearing organic compound and carbamate combination of the aqueous functional fluid composition according to this invention a water soluble or dispersible carbamate having the following formula

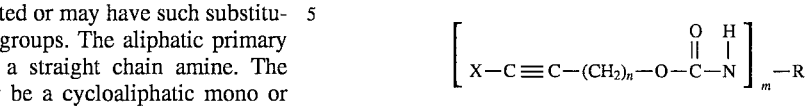

where

X is bromine, chlorine, flourine or iodine,

R is an aliphatic, aromatic or alkylaromatic group having 1 to 20 carbon atoms and a free valence equal to m, m is a whole integer from 1 to 3 and n is a whole integer from 1 to 3.

The carbamates in accordance with this formula may, for example, be carbamates wherein A. X is bromine, chlorine, fluorine or iodine, R is alkyl having from 1 to 20 carbon atoms, n is 1 and m is 1

B. X is bromine, chlorine, fluorine or iodine, R is aryl having from 6 to 10 carbon atoms, m is 1 and n is 1

C. X is iodine, R is alkyl having 1 to 20 carbon atoms, n is 1 or 2 and m is 1 or 2

D. X is bromine, R is alkyl having 1 to 20 carbon atoms, n is 1 or 2 and m is 1 or 2

E. X is chlorine, R is alkyl having 1 to 20 carbon atoms, n is 1 or 2 and m is 1 or 2

F. X is bromine, chlorine, or iodine, R is butyl, m is 1 and n is 1 and preferably, G. X is iodine, R is butyl, m is 1 and n is 1 known as 3-iodo-2 propynylbutyl carbamate. The carbamate usable in the nitrogen bearing organic compound and carbamate combination of the aqueous functional fluid composition of this invention may be prepared by processes well known in the art. In one such process halogenating (e.g. iodinating) an acetylenic alcohol (e.g. propynol) and reacting the product of the halogenation reaction with an isocyanate (e.g. n-butyl isocyanate, t-butyl isocyanate, hexyl isocyanate, octyl isocyanate, dodecyl isocyanate, octadecyl isocyanate, phenyl isocyanate, o-toluene diisocyanate, m-toluene diisocyanate and p-toluene diisocyanate) is carried out. The halogenation step can be carried out in the presence of sodium hypochlorite and an alkali metal halide and the product isolated by extraction with ether. In the second step (i.e. urethane reaction) the halogenated acetylenic alcohol maybe reacted with the isocyanate in tetrahydrofuran in the presence of small amounts of triethylamine and dibutyltin dialaurate and the product then purified. The preparation of carbamates is described in U.S. Pat. No. 3,923,870 to W. Singer.

In the nitrogen bearing organic compound and carbamate combination of the aqueous functional fluid composition of this invention there may be employed a wide range of concentrations for each of the nitrogen bearing organic compound and carbamate constituents of the combination. Aqueous functional fluids, such as for example aqueous metalworking fluids and aqueous hydraulic fluids, are employed in a variety of applications and are stored and used in a variety of environments (e.g. exposure to various metal particles, organic contaminants (tramp oil) and micro-organisms). The composition of the aqueous functional fluid is often tailored to the end use to which the fluid is put. Thus concentrations of each of the components of the combination will vary with the chemical composition of each component, the composition of the aqueous functional fluid, the intended use of the fluid and the environment in which the aqueous functional fluid will be stored and used, particularly the micro-organisms to which the fluid can and will be exposed. As examples of the concentration ranges that may be employed there include a range of from 0.1 to 20.0% by weight, based on the total aqueous functional fluid composition, for the water soluble or dispersible nitrogen bearing organic compound or salt thereof selected from the group consisting of substituted and unsubstituted aliphatic, aromatic and alicyclic primary amines and salts thereof and 5 and 6 membered ring heterocyclic compounds having at least one nitrogen ring atom and optionally oxygen or sulfur hetero ring atoms and salts thereof and a range of from 0.005 to 1.0% by weight, based on the total aqueous functional fluid composition, for the water soluble or dispersible carbamate having the following formula $$\left[ X-C\equiv C-(CH_2)_n-O-\overset{\overset{O}{\|}}{C}-\overset{\overset{H}{|}}{N} \right]_m -R$$

where

X is bromine, chlorine, fluorine or iodine,

R is an aliphatic, aromatic or alkylaromatic group having 1 to 20 carbon atoms and a valence equal to m, m is a whole integer from 1 to 3 and n is a whole integer from 1 to 3.

Preferably the nitrogen bearing organic compound is used in a concentration range of from 0.2 to 15% by weight and the carbamate is used in a concentration range of from 0.01 to 0.5% by weight.

In the aqueous functional composition according to this invention the water may be present in an amount ranging from about 1.0% to about 99.5% by weight based on the total composition. Preferably the water is present in a concentration range of from 10% to about 99% by weight, more preferably from 20% to 85% by weight. It is a common practice in the art to prepare and ship functional fluid concentrates in which a very small amount (e.g. 1.0% by weight) of water is present in the composition. These fluid concentrates are then diluted with water to a use concentration by the end user. Such a practice reduces shipping expenses by permitting the shipment of a larger amount of the components of the composition other than water and avoiding the cost of shipping water to the end user. Thus in the context of this specification and the attached claims the phrases aqueous functional fluid composition, aqueous based functional fluid composition, aqueous metalworking fluid composition, aqueous metalworking fluid, aqueous hydraulic fluid composition and comparable expressions within the scope of this invention are intended to apply to concentrated compositions having little water and to diluted compositions having from significant to high amounts of water.

The functioning agent component of the aqueous functional fluid composition according to this invention must be a water soluble or dispersible material. Various organic and inorganic materials may be utilized. Preferably water soluble or dispersible organic substances or compounds are employed as the functioning agent. The organic substance or compound is a synthetic or naturally occurring substance and preferably is a synthetic or naturally occurring substance or compound having lubricating (i.e. friction reducing) characteristics in the aqueous functional fluid composition of this invention. A modified naturally occurring organic substance may be used as the functioning agent. Examples of an organic functioning agent include, but are not limited to, esters of fatty acids, polyalkylene glycols, polyoxyalkylene glycols, soaps, modified petroleum oil, sulfonated petroleum oil, sulfurized petroleum oil, vegetable oil, glycerides and organic silicon compounds. The functioning agent may be a mixture of synthetic organic compounds, synthetic and naturally occurring organic substances, synthetic substances and modified and unmodified petroleum based oil and organic and inorganic substances well known in the art, especially the art pertaining to aqueous based hydraulic fluids and metalworking fluids.

An aqueous functional fluid composition, more especially an aqueous hydraulic fluid composition and aqueous metalworking fluid composition, according to this invention may optionally contain various additives well known in the art such as for example corrosion inhibitors, surfactants, emulsifiers, extreme pressure agents, antifoam agents and antimisting agents. The compositions and usable concentrations of these additives are well known in the art and such compositions and concentrations may be optionally employed in the practice of this invention.

In accordance with this invention there is provided an aqueous functional fluid composition free of formaldehyde and formaldehyde producing agents, more particularly an aqueous hydraulic fluid composition and aqueous metalworking fluid composition having improved stability (i.e. resistance) to attack by micro-organisms such as, for example, bacteria and fungi. The preferred practice of this invention is an aqueous metalworking fluid having improved resistance to attack by micro-organisms, without the use of formaldehyde and formaldehyde producing agents, comprising a) water, b) a water soluble or dispersible functioning agent selected from the group consisting of synthetic, naturally occurring and modified naturally occurring organic substances having friction reducing characteristics and c) an antimicrobial effective amount of the combination comprising d) a water soluble or dispersible nitrogen bearing organic compound or salt thereof selected from the group consisting of substituted and unsubstituted aliphatic, aromatic and alicyclic primary amines and salts thereof and 5 and 6 membered ring heterocyclic compounds having at least one nitrogen ring atom and optionally oxygen or sulfur hetero ring atoms and salts thereof and e) a water soluble or dispersible carbamate having the following formula $$\left[ X-C\equiv C-(CH_2)_n-O-\overset{\overset{O}{\|}}{C}-\overset{\overset{H}{|}}{N} \right]_m -R$$

where

X is bromine, chlorine, fluorine or iodine,

R is an aliphatic, aromatic or alkylaromatic group having 1 to 20 carbon atoms and a valence equal to m, m is a whole integer from 1 to 3 and n is a whole integer from 1 to 3.

This preferred aqueous metalworking fluid composition more preferably contains an antimicrobial effective amount of the combination comprising a water soluble or dispersible alkanolamine or salt thereof and 3-iodo -2-propynyl butyl carbamate.

The term functioning agent as used throughout this specification and the accompanying claims shall mean a substance or combination of substances that provides for or assists in the principle performance of the aqueous functional fluid composition of this invention for its intended purpose. Thus for example in an aqueous metalworking fluid composition according to this invention the functioning agent can be a synthetic organic lubricant providing friction reducing characteristics to the fluid when the fluid is employed in a metalworking process (e.g. metal cutting operation).

The aqueous based functional fluid compositions of this invention may be prepared by conventional methods well known in the art. Thus the a) water, b) water soluble or dispersible functioning agent, c) nitrogen bearing organic compound or salt thereof selected from the group consisting of substituted and unsubstituted aliphatic, aromatic and alicyclic primary amines and salts thereof and 5 and 6 membered ring heterocyclic compounds having at least one nitrogen ring atom and optionally oxygen or sulfur hetero ring atoms and salts thereof and d) water soluble or dispersible haloalkynylalkylcarbamate may be combined in various manners in preparing the aqueous functional fluid compositions of this invention. Depending on the chemical and/or physical characteristics of the components of the aqueous functional fluid composition, it may be desirable to use a specific order of addition of the components when blending them together, so as to achieve an optimum or preferred fluid composition. By way of example, it may be desirable to employ a surfactant or emulsifier along with a water dispersible component of the fluid composition and the component may be preblended with the surfactant or emulsifier and then added to water or the component may be added to the aqueous medium (i.e. water with or without other components of the composition therein) containing a surfactant or emulsifier depending upon the chemical and/or physical characteristics of the water dispersible component and/or the surfactant or emulsifier.

This invention will now be further described in the following non-limiting examples in which all amounts, proportions, ratios and percentages are by weight and all temperatures are in degrees Fahrenheit unless otherwise indicated.

Formulations

| Ingredient | Example No. 1 | 2 | 3 | 4 | 5 | 6 | 7 |
|---|---|---|---|---|---|---|---|
| Water | 80.7 | 81.9 | 83.3 | 80.5 | 87.9 | 73.4 | 79.4 |
| Pelargonic acid | 0.5 | 0.5 | 0.5 | 0.5 | 0.5 | | |
| Neo-decanoic acid | 3.6 | 3.6 | 3.6 | 3.6 | 3.6 | 1.0 | 1.0 |
| Diethylene glycol | 0.4 | 0.4 | 0.4 | 0.4 | 0.4 | | |
| Oil | | | | | | 5.0 | 5.0 |
| Schercomid TO-2* | | | | | | 4.5 | 4.5 |
| Tall oil | | | | | | 1.5 | 1.5 |
| Nonylphenol 9.5 EO** | | | | | | 1.0 | 1.0 |
| Boric acid | 6.0 | 6.0 | 6.0 | 6.0 | | 6.0 | |
| 3-iodo-2-propynyl butylcarbamate | 0.1 | 0.1 | 0.1 | 0.1 | 0.1 | 0.1 | 0.1 |
| Tetrahydrol-oxazine | 8.7 | | | | | | |
| Monoisopropanol-amine | | 7.5 | | | 7.5 | 7.5 | 7.5 |
| Monoethanolamine | | | 6.1 | | | | |
| AMP*** | | | | 8.9 | | | |
| Test result (days to termination) | 16 | 30 | 30 | 16 | 30 | >50 | >50 |

Comparative Formulations

| Ingredients | Example No. 8 | 9 | 10 | 11 | 12 | 13 | 14 |
|---|---|---|---|---|---|---|---|
| Water | 82.0 | 88.0 | 73.5 | 79.5 | 78.9 | 83.0 | 74.5 |
| Pelargonic acid | 0.5 | 0.5 | | | 0.5 | 0.5 | |
| Neo-decanoic acid | 3.6 | 3.6 | 1.0 | 1.0 | 3.6 | 3.6 | 1.0 |
| Diethylene glycol | 0.4 | 0.4 | | | 0.4 | 0.4 | |
| Oil | | | 5.0 | 5.0 | | | 5.0 |
| Schercomid TO-2* | | | 4.5 | 4.5 | | | 4.5 |
| Tall oil | | | 1.5 | 1.5 | | | 1.5 |
| Nonylphenol 9.5 EO** | | | 1.0 | 1.0 | | | 1.0 |
| Boric acid | 6.0 | | 6.0 | | 6.0 | 6.0 | 6.0 |
| 3-iodo-2-propynyl-butylcarbamate | | | | | 0.1 | | |
| Monoisopropanol-amine | 7.5 | 7.5 | 7.5 | 7.5 | | | |
| Diethanolamine | | | | | | 10.5 | |
| Potassium hydroxide | | | | | | | 6.5 | 6.5 |
| Test results (days to termination) | 10 | 10 | 18 | 11 | 4 | 2 | 8 |

Comparative Formulations

| Ingredients | Example No. 15 | 16 | 17 | 18 | 19 | 20 |
|---|---|---|---|---|---|---|
| Water | 82.9 | 88.9 | 89.0 | 74.4 | 80.4 | 80.5 |
| Pelargonic acid | 0.5 | 0.5 | 0.5 | | | |
| Neo-decanoic acid | 3.6 | 3.6 | 3.6 | 1.0 | 1.0 | 1.0 |
| Diethylene glycol | 0.4 | 0.4 | 0.4 | | | |
| Oil | | | | 5.0 | 5.0 | 5.0 |
| Schercomid TO-2* | | | | 4.5 | 4.5 | 4.5 |
| Tall oil | | | | 1.5 | 1.5 | 1.5 |
| Nonylphenol 9.5 EO** | | | | 1.0 | 1.0 | 1.0 |
| Boric acid | 6.0 | | | 6.0 | | |
| 3-iodo-2-propynyl-butylcarbamate | 0.1 | 0.1 | | 0.1 | 0.1 | |
| Potassium hydroxide | 6.5 | 6.5 | 6.5 | 6.5 | 6.5 | 6.5 |
| Test result (days to termination) | 3 | 4 | 2 | 2 | 2 | 2 |

*Tall oil acids reacted 2:1 with diethanolamine - Scher Chemical Industries Inc. Schercomid is a registered trademark of Scher Chemical Industries Inc.
**nonylphenol ethoxylated with 9.5 moles of ethylene oxide
**2-amino-2-methyl-1-propanol The replacement of the potassium hydroxide in examples 16 to 20 with 14.9 parts of triethanolamine and the corresponding adjustment of the water content of examples 16 to 20 yielded comparative formulations which gave test results of from 2 to 4 days compared to the test results of 2 to 3 days for examples 16 to 20.

Each of the formulations of the above examples were tested for bacteria control performance (i.e. resistance to bacterial growth) in accordance with the following test procedure. The test results, stated in terms of the number of days to the termination of the test, are given at the end of each of the above examples.

Test Procedure

The test liquid was prepared by mixing 97 grams of sterile, 125 PPM total hardness water with 3 grams of the formulation to be tested in a beaker until a uniform liquid was obtained, using a magnetic stirrer. The pH of the test liquid was then adjusted to 8.5 by bubbling $CO_2$ into the test liquid while continuing to agitate the liquid. 100 grams of the test liquid was then placed in a sterile 8 ounce French square bottle and the liquid innoculated with 0.02 milliliters of a standard mix bacteria culture inocula of gram negative bacteria that included *Citrobacter sp., Enterobacter sp., Escherichia coli, Proteus sp.* and *Pseudomonas sp.*. The capped French square bottle containing the bacteria inoculated test liquid and having the cap loosened one quarter turn was placed on a gyratory shaker and the liquid agitated continuously during the test. Using a Easicult dip slide and procedure from Orion Diagnostic Inc. the bacteria level (i.e. count) in the test liquid was determined on a daily basis. Failure of the test liquid and thus termination of the test was considered to occur when two consecutive daily bacteria counts reached 107 bacteria per milliliter or greater. The test result is expressed in the number of days to termination of the test. The longer the test liquid went before reaching two consecutive daily bacteria counts of 107 or greater the better was the bacteria control performance of the test liquid and thus the formulation.

This invention has been described with reference to non-limiting specific embodiments. It will be recognized by those skilled in the art that various other embodiments may be practiced that are within the intent and scope of this disclosure and claimed invention and are therefore intended to be and are to be included within the scope of this disclosure and the appended claims.

What is claimed is:

1. An aqueous metalworking fluid composition, free of formaldehyde and formaldehyde producing agents, having improved resistance to attack by bacteria comprising a) water, b) a water soluble or dispersible organic lubricant selected from the group consisting of water soluble or dispersible synthetic, naturally occurring and modified naturally occurring organic substances and mixtures thereof having a friction reducing characteristic, c) a bacteria controlling effective amount of the combination comprising, d) a water soluble or dispersible nitrogen bearing organic compound or salt thereof selected from the group consisting of a halogen or hydroxyl and unsubstituted aliphatic primary amines and salts thereof and morpholine and e) a water soluble or dispersible carbamate having the formula $$\left[ X-C\equiv C-(CH_2)_n-O-\overset{\overset{\displaystyle O}{\|}}{C}-\overset{\overset{\displaystyle H}{|}}{N} \right]_m -R$$

where

X is iodine

R is an aliphatic, aromatic or alkylaromatic group having from 1 to 20 carbon atoms and a free valence equal to m m is a whole integer from 1 to 3 and n is a whole integer from 1 to 3.

2. An aqueous metalworking fluid composition according to claim 1 wherein the nitrogen bearing organic compound is a hydroxyl substituted aliphatic primary amine or salt thereof.

3. An aqueous metalworking fluid composition according to claim 2 wherein R is an alkyl group, m is 1 and n is 1.

4. An aqueous metalworking fluid composition according to claim 1 wherein the nitrogen bearing organic compound is an aliphatic primary amine and said amine is a polyamine having at least one primary amine group or salt thereof.

5. An aqueous metalworking fluid composition according to claim 1 wherein the carbamate is 3-iodo-2-propynylbutyl carbamate.

6. An aqueous metalworking fluid composition according to claim 1 wherein the nitrogen bearing organic compound is a hydroxy aliphatic primary amine or salt thereof and the carbamate is 3-iodo- 2-propynylbutyl carbamate.

7. An aqueous metalworking fluid composition according to claim 6 wherein the nitrogen bearing organic compound is monoisopropanol amine.

8. An aqueous metalworking fluid composition according to claim 6 wherein the nitrogen bearing organic compound is monoethanolamine.

9. An aqueous metalworking fluid composition according to claim 1 wherein the nitrogen bearing organic compound is morpholine.

* * * * *